US006568015B1

(12) United States Patent
Allen

(10) Patent No.: US 6,568,015 B1
(45) Date of Patent: May 27, 2003

(54) PRONE POSITIONING MATTRESS

(76) Inventor: Donna C. Allen, 1640 Garwood Dr., Dayton, OH (US) 45432

( * ) Notice: Subject to any disclaimer, the term of this patent is extended or adjusted under 35 U.S.C. 154(b) by 0 days.

(21) Appl. No.: 09/614,088

(22) Filed: Jul. 12, 2000

(51) Int. Cl.[7] ..... A47C 27/10
(52) U.S. Cl. ..... 5/735; 5/731; 5/930
(58) Field of Search ..... 5/735, 648, 731, 5/930, 631, 630

(56) References Cited

U.S. PATENT DOCUMENTS

| | | | | |
|---|---|---|---|---|
| 3,378,862 A | | 4/1968 | Skinner | |
| 3,988,793 A | | 11/1976 | Abitbol | |
| 4,382,306 A | | 5/1983 | Lickert | |
| 4,827,541 A | | 5/1989 | Vollman et al. | |
| 4,937,901 A | | 7/1990 | Brennan | |
| 5,237,712 A | | 8/1993 | Ramsay | |
| 5,249,318 A | | 10/1993 | Loadsman | |
| 5,400,449 A | | 3/1995 | Satto | |
| 5,652,981 A | * | 8/1997 | Singer-Leyton et al. | 5/631 |
| D384,852 S | | 10/1997 | Koshaba et al. | |
| 5,720,061 A | | 2/1998 | Giori et al. | |
| D392,145 S | * | 3/1998 | Thurston | 5/930 |
| 5,819,348 A | | 10/1998 | Ryan | |
| 5,890,246 A | | 4/1999 | Davis | |
| 6,038,722 A | | 3/2000 | Giori et al. | |
| 6,058,538 A | | 5/2000 | Chapman et al. | |
| 6,067,678 A | * | 5/2000 | Trevino | 5/628 |
| 6,131,219 A | * | 10/2000 | Roberts | 5/644 |

* cited by examiner

*Primary Examiner*—Teri Pham Luu
*Assistant Examiner*—Fredrick Conley
(74) *Attorney, Agent, or Firm*—Wegman, Hessler & Vanderburg

(57) ABSTRACT

A mattress for comfortably supporting an individual with an abdominal condition requiring minimal contact between the mattress and the individual's abdomen, while also providing a structure for facilitating the turning of the individual between supine and prone positions. The mattress comprises a resilient mattress body including upper and lower surfaces, top and bottom edges, and first and second side edges. An inner abdominal support wall defines an abdominal receiving chamber positioned intermediate the top and bottom edges and extending downwardly form the upper surface of the mattress body. The mattress further comprises an outer abdominal support wall and an inflatable chamber defined intermediate the inner and outer abdominal support walls. An adjustable shoulder support is positioned intermediate the top edge and the abdominal receiving chamber. An adjustable pillow is positioned above the upper surface of the mattress body intermediate the shoulder support and the top edge. A securing device extends above the upper surface of the mattress body proximate the first side edge to proximate the second side edge and is adapted for securing the mattress body to the individual.

14 Claims, 5 Drawing Sheets

PRONE POSITIONING MATTRESS

BACKGROUND OF THE INVENTION

1. Field of the Invention

The present invention relates generally to mattresses and, more particularly, to a mattress for facilitating the turning of an individual between supine and prone positions in a simple and efficient manner while providing improved comfort for the individual supported on the mattress.

2. Description of the Related Art

An unfortunate complication of an individual lying relatively immobile during prolonged periods of time is the manifestation of decubitus ulcers, commonly known as "bed sores," on the body dermis which experiences unrelieved contact with a firm surface. As such, bedridden individuals need to be turned between a supine, face-up, position and a prone, face-down, position quite frequently. Such turning not only prevents the manifestation of bed sores, but also avoids serious discomfort resulting from lying in one position for a prolonged period of time.

Further, individuals requiring mechanical ventilation or artificial respiration may need to be nursed in the prone position in order to increase the oxygen level in arterial blood. Such prone nursing is a technique in widespread use, and many systems have been developed to assist a caretaker in turning a individual from a supine to a prone position and vice versa. For example, U.S. Pat. No. 4,937,901 to Brennan discloses a rotatable stretcher supported for rotation above an operating table, thereby allowing rotation of the individual supported thereon.

However, such prior art systems fail to provide a support structure for use with individuals having conditions requiring that no pressure be applied to the abdominal area. For example, individuals who have had abdominal surgery require hat the area proximate the abdomen be free from contact with support surfaces. likewise, many pregnant women find it uncomfortable to have pressure applied against their expanded abdomens.

While several mattresses have been proposed for supporting pregnant women in a prone position, these mattresses fail to provide devices for assisting in the turning of the individual between supine and prone positions. Examples of such mattresses are disclosed in U.S. Pat. No. 3,988,793 to Abitbol and U.S. Pat. No. 4,382,306 to Lickert.

Accordingly, there is a need for a mattress which facilitates the turning of an individual supported thereon between supine and prone positions, while simultaneously providing a structure for relieving pressure against the abdominal area of the individual.

Furthermore, the prior art fails to provide a mattress providing an abdomen pressure relief area in combination with an adjustable shoulder support. Such a shoulder support is necessary not only for individual comfort, but for lifting the individual's chest off the mattress to provide a space beneath the face and neck for nasal, ventilation and tracheotomy tubes to be inserted and hang freely from the individual. When the individual is in such a position, a caregiver has access to the face and neck areas for naso-gastric tubes, endo-gastric tubes, ventilator hoses and tracheotomy tubing, as appropriate, and can perform medical procedures such as pulmonary drainage via suction.

Accordingly, there is a need for a mattress providing an abdominal pressure relief area in combination with a simple and efficient adjustable shoulder support.

SUMMARY OF THE INVENTION

The present invention provides a mattress for comfortably supporting an individual, particularly one with an abdominal condition requiring minimal contact between the mattress and the individual's abdomen. Additionally, the mattress of the present invention provides a structure for facilitating the turning of an individual between supine and prone positions.

The mattress of the present invention comprises a resilient mattress body, the mattress body including opposing upper and lower surfaces, opposing top and bottom edges, and opposing first and second side edges connecting the top and bottom edges. An inner abdominal support wall defines an abdominal receiving chamber positioned intermediate the top and bottom edges and the first and second side edges. The abdominal receiving chamber extends downwardly from the upper surface of the mattress body and is adapted for receiving the abdomen of an individual supported in a prone position on the upper surface. A plug is removably receivable within the abdominal receiving chamber when the chamber is not required by the individual supported on the mattress.

The mattress further comprises an outer abdominal support wall and an inflatable chamber defined intermediate the inner abdominal support wall and the outer abdominal support wall. The inner and outer abdominal support walls have generally cylindrical configurations and are substantially concentrically disposed relative to each other, thereby defining a substantially toroidal inflatable chamber.

An adjustable shoulder support is positioned intermediate the top edge and the abdominal receiving chamber, the adjustable shoulder support including a shoulder support surface adapted for contacting the shoulders of the individual supported on the upper surface. The adjustable shoulder support further comprises an adjustment device for moving the shoulder support surface relative to the upper surface of the mattress body. More particularly, the mattress shoulder support includes a chamber defined intermediate the upper surface of the mattress body and the shoulder support surface, the shoulder support further including an open end in communication with the chamber. The adjustment device preferably comprises a resilient insert slidably receivable within the chamber of the shoulder support through the open end.

An adjustable pillow is positioned above the upper surface of the mattress body intermediate the shoulder support and the top edge. The pillow includes a head support surface and a plurality of recesses extending downwardly from the head support surface for receiving medical instruments.

A securing device extends above the upper surface of the mattress body proximate the first side edge to proximate the second side edge and is adapted for securing the mattress body to the individual. The securing device preferably comprises at least one securing strap having first and second ends, the first end secured to the mattress body proximate the first side edge of the mattress body. The securing device further comprises a first releasable fastener for securing the second end of the at least one securing strap relative to the second side edge of the mattress body.

The securing device preferably further comprises a flexible sheet having opposing first and second longitudinally extending sides, the first side of the sheet secured proximate the first edge of the mattress body intermediate the at least one securing strap and the upper surface of the mattress body. A second releasable fastener detachably secures the sheet to the mattress body.

In operation, the mattress of the present invention is typically used to initially move an individual from a supine position as supported on a conventional support surface, such as a bed, to a prone position supported on the mattress body. The mattress is placed on top of the individual, with the upper surface facing the front of the individual, the upper end of the mattress positioned proximate the head of the individual, and the lower end of the mattress positioned proximate the feet of the individual. The individual's head is aligned with the inflatable pillow, shoulders aligned with the shoulder support and abdomen aligned with the abdominal receiving chamber.

Next, the individual is secured to the mattress body by wrapping the flexible sheet underneath the body of the individual and securing it in place with the securing strap. The securing strap and sheet are secured in place through the first releasable fastener. Next, the caregiver rotates the mattress, along with the individual supported thereon, 180° along the longitudinal axis of the mattress body. The lower surface of the mattress is then placed on a support member, such as a table or bed, such that the upper surface faces upwardly. As such, the individual is now in a prone position (i.e., facing downwardly). The securing strap and flexible sheet may then be released from the mattress body.

To turn the individual from the prone position to the supine position, the above steps are merely reversed.

Therefore, it is an object of the invention to provide a mattress for facilitating the turning of an individual between supine and prone positions.

It is a further object of the invention to provide such a mattress for supporting an individual with an abdominal condition requiring minimal contact with his or her abdomen.

It is another object of the present invention to provide a mattress with a structure for facilitating the comfort of the individual.

It is a further object of the invention to provide such a mattress including an adjustable shoulder support.

It is yet another object of the invention to provide such a mattress including means for securing an individual to the mattress when being turned between supine and prone positions.

Other objects and advantages of the invention will be apparent from the following description, the accompanying drawings and the appended claims.

DETAILED DESCRIPTION OF THE PREFERRED EMBODIMENT

Figure 1:
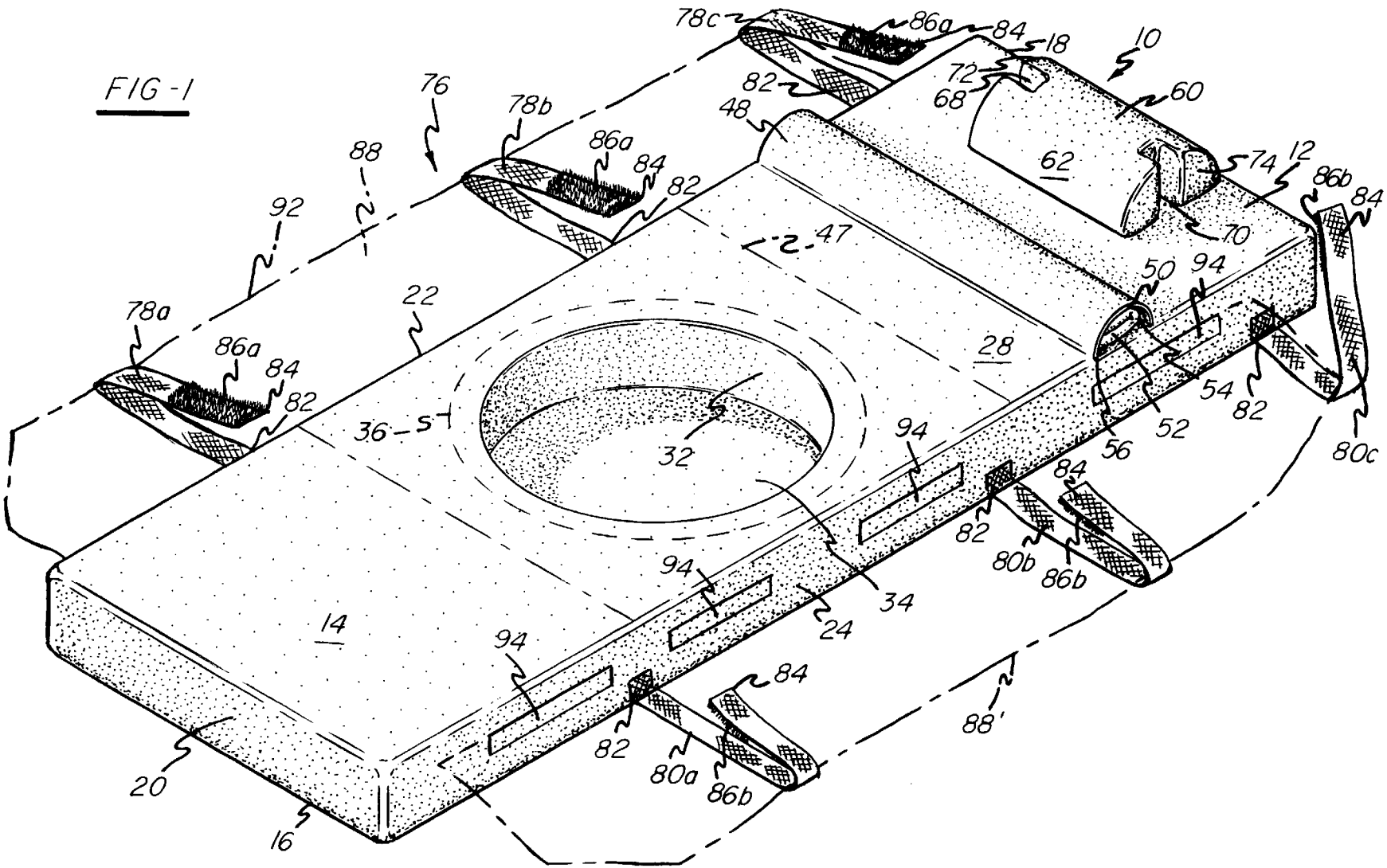
FIG. 1 is a perspective view of the mattress of the present invention with the plug removed, and the cover and sheets illustrated in phantom for clarity.
Figure 2:
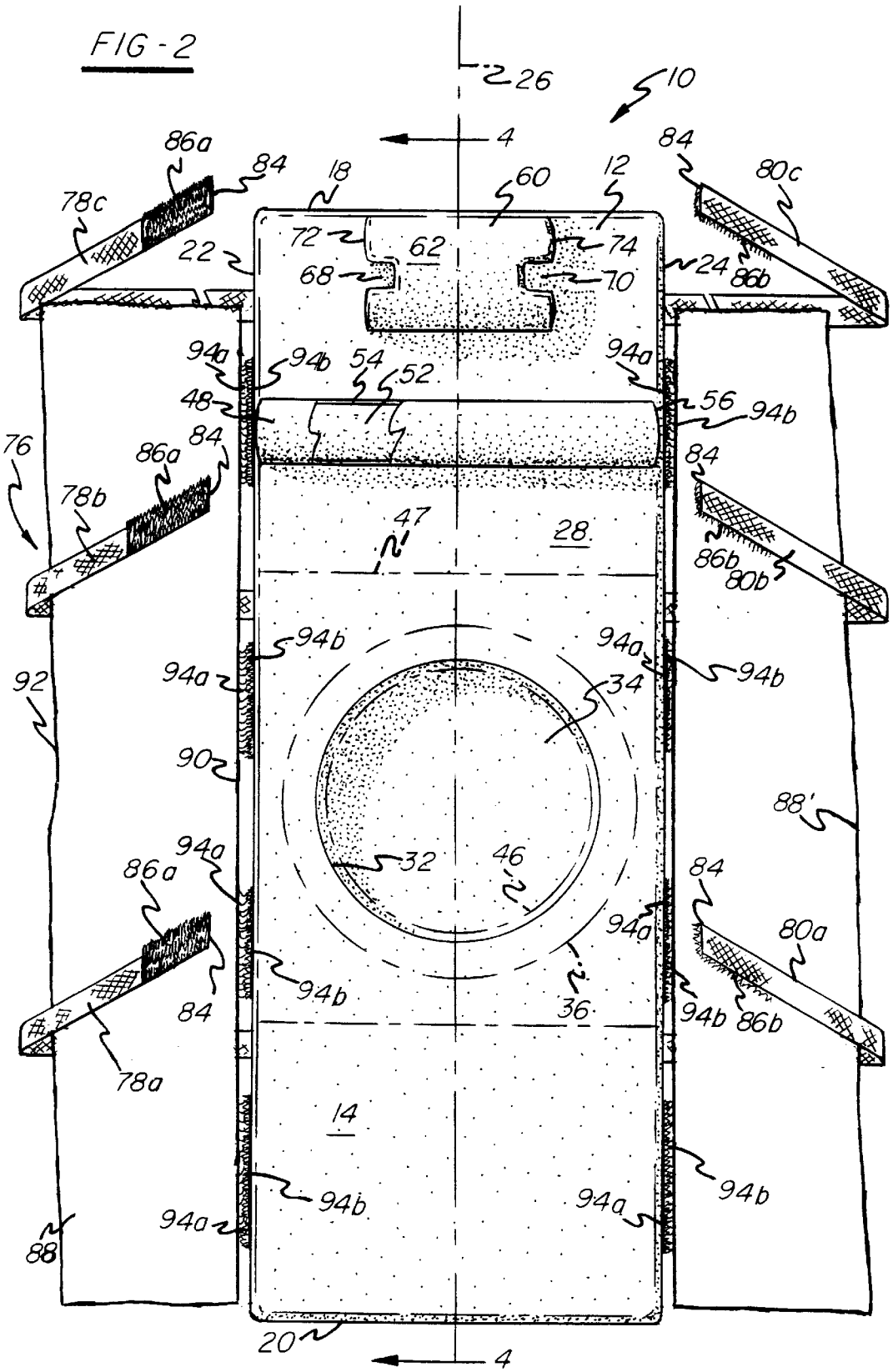
FIG. 2 is a top plan view of the mattress of the present invention with the plug and cover illustrated in phantom for clarity.
Figure 3:
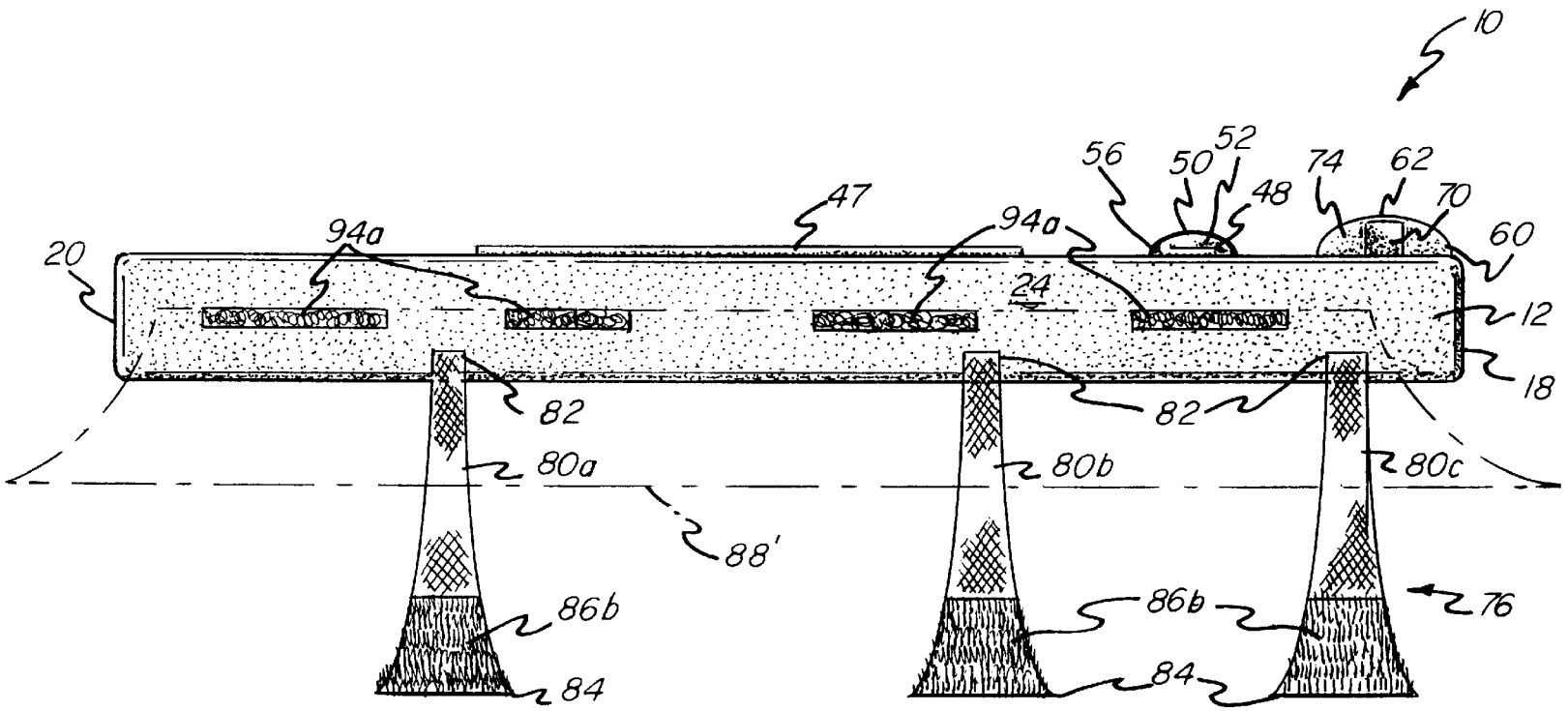
FIG. 3 is a side elevational view of the mattress of the present invention with the sheet shown in phantom for clarity.

Referring initially to FIGS. 1–3, the prone positioning mattress 10 of the present invention includes a resilient mattress body 12. The mattress body 12 includes upper and lower surfaces 14 and 16 extending between opposing top and bottom edges 18 and 20 and opposing first and second longitudinally extending side edges 22 and 24. A longitudinal axis 26 of the mattress body 12 is defined intermediate the opposing first and second side edges 22 and 24 (FIG. 2).

The upper and lower surfaces 14 and 16, top and bottom edges 18 and 20, and first and second side edges 22 and 24 of the mattress body 12 define an outer shell 28 encasing a cushioning material 30. The outer shell 28 may be formed of any "breathable" and readily cleanable material of sufficient resiliency. Moreover, the breathability of the fabric is important in order to prevent skin breakdown of an individual supported upon the mattress 10. Fabrics having a relatively high permeability to a gaseous mixture, such as air, and substantial impermeability to solids and liquids, include various plastics and synthetics. In the most preferred embodiment, the material sold under the trademark Gor-Tex® is utilized for the outer surface 28. Gor-Tex® fabrics are available from W. L. Gore and Associates, Inc. of Newark, Del.

The cushioning material 30 may comprise any acceptable foam having sufficient durability. Likewise, the cushioning material 30 may comprise a fluid, such as air.

The outer shell 28 of the mattress body 12 further includes an inner abdominal support wall 32 defining a substantially cylindrical abdominal receiving chamber 34 extending downwardly from the upper surface 14 of the mattress body 12. As may be readily appreciated, the abdomen of an individual supported in a prone position on the mattress 10 may be received within the receiving chamber 34 to prevent contact with the individual's abdomen. An outer abdominal support wall 36 is concentrically received outside of the inner abdominal support wall 32. A substantially toroidal inflatable chamber 38 is defined intermediate the inner and outer abdominal support walls 32 and 36 and upper and lower walls 40 and 42, which are connected to the upper and lower surfaces 14 and 16 of the mattress body 12.

Figure 4:
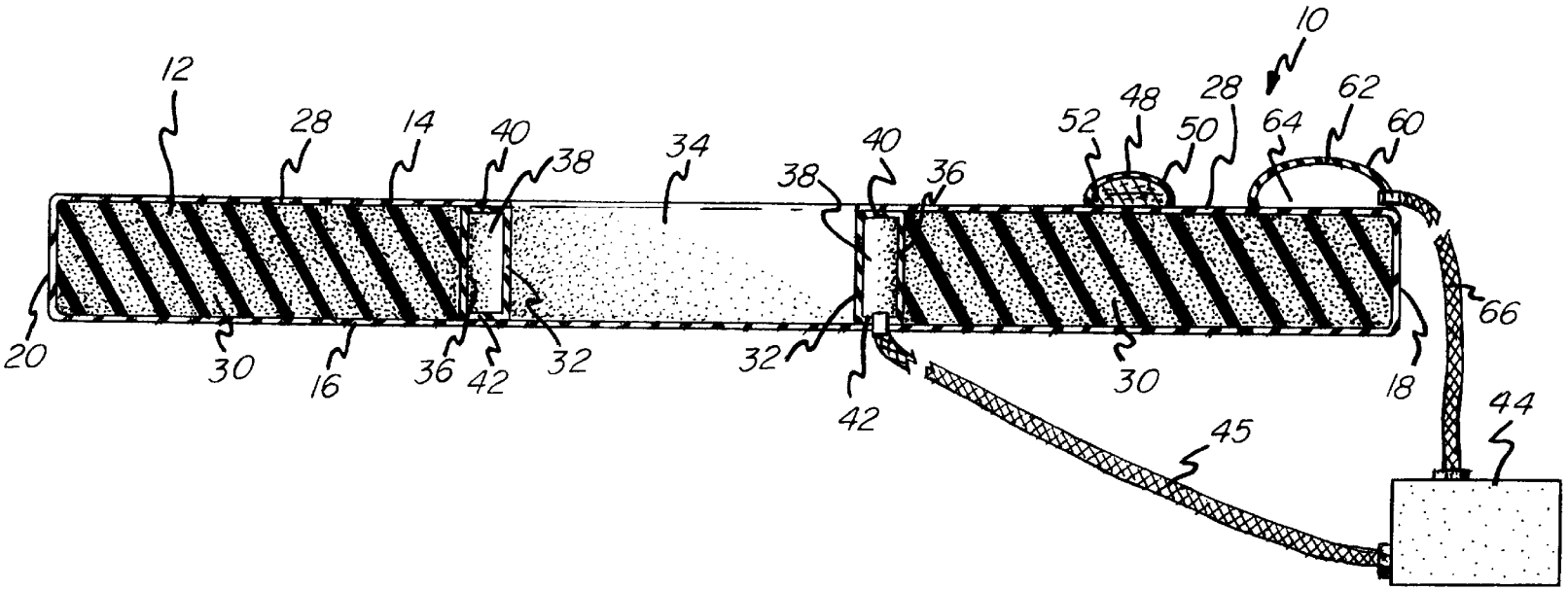
FIG. 4 is a cross-sectional view taken along line 4—4 of FIG. 2.

With further reference to FIG. 4, the inflatable chamber 38 is releasably connected in fluid communication with a fluid supply 44 through a conduit 45. The fluid supply 44 may remain semi-permanently connected to the mattress 10 in order to provide constant pressure to the inflatable chamber 38. Alternatively, the fluid supply 44 may be connected to the mattress 10 only as needed to inflate the chamber 38. The size of the inflatable chamber 38 may be adjusted based upon the amount of fluid supplied thereto. As such, the receiving chamber 38 may be customized for different individuals.

Figure 5:
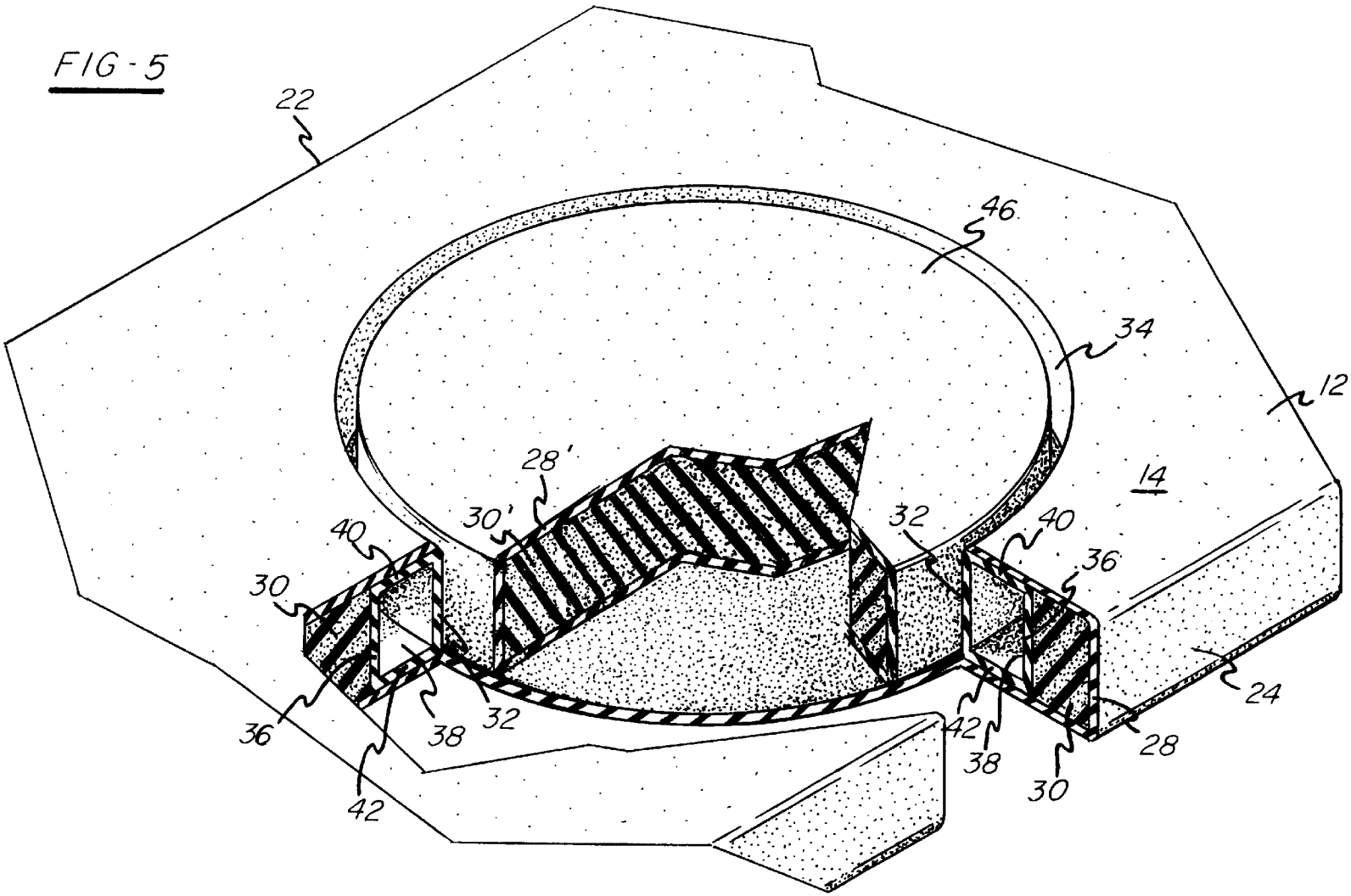
FIG. 5 is a detailed view of the abdominal receiving chamber and plug of the mattress of the present invention.

Referring to FIG. 5, it should be noted that in situations where the individual supported in a prone position on the mattress 10 does not require the abdominal chamber 38, then a plug 46 may be slidably received therein for providing additional support to the individual. The plug 46 is preferably cylindrical in shape and is concentrically positioned relative to, and in proximity with, the inner abdominal support wall 32. Additionally, the plug 46 preferably includes an outer shell 28' and cushioning material 30' similar to the mattress body 12. A cover 47 may also be positioned above the plug 46 and a portion of the upper surface 14 of the mattress body 12 to provide a smooth support surface for contacting the individual.

An adjustable shoulder support 48 is positioned above the upper surface 14 of the mattress body 12 intermediate the abdominal chamber 38 and the top edge 18 for supporting the shoulders of an individual supported by the mattress 10. The adjustable shoulder support 48 includes a shoulder support surface 50 and an adjustment device 52 for altering the position of the shoulder support surface 50 relative to the upper surface 14 of the mattress body 12. In the preferred embodiment, the shoulder support 48 includes a chamber 54 having an open end 56 defined intermediate the shoulder support surface 50 and the upper surface 14. The adjustment device 52 preferably comprises an insert 58, preferably a blanket roll, which is positioned within the chamber 54 through the open end 56. As such, the shoulder support surface 50 may be readily adjusted for the individual user to position his or her shoulders away from the upper surface of the mattress body 12. Alternatively, the adjustment device 52 may comprise a fluid received within the chamber 54, wherein the open end 56 would be sealable.

An adjustable pillow 60 is provided above the upper surface 14 of the mattress body 12 intermediate the shoulder support 48 and the top edge 18. The adjustable pillow 60 includes a head support surface 62 which may be vertically adjusted relative to the upper surface 14 of the mattress body 12. Moreover, a chamber 64 is provided intermediate the head support surface 62 and the upper surface 14 of the mattress body 12 for receiving a fluid, preferably air (FIG. 4). The air is supplied by a conduit 66 connected to the fluid supply 44. Again, the fluid supply 44 may be semi-permanently attached to the chamber 64, but more preferably is releasably attached for selective inflation of the pillow 60.

Recesses 68 and 70 extend downwardly from the head support surface 62 of the inflatable pillow proximate opposing side edges 72 and 74 thereof The recesses 68 and 70 provide clearance for medical devices attached proximate the face or neck of the individual supported on the mattress 10, such as naso-gastric tubes, endo-gastric tubes, ventilator hoses and tracheotomy tubing, for the purposes of administering oxygen and/or anesthetic.

A securing device 76 is provided for securing an individual to the upper surface 14 of the mattress body 12 during a turning procedure. The securing device 76 preferably includes a plurality of first securing straps 78*a,* 78*b,* 78*c* fixed to the first side edge 22 of the mattress body 12. Likewise a plurality of cooperating second securing straps 80*a,* 80*b,* 80*c* are fixed to the second side edge 24 of the mattress body 12. Each of the securing straps 78*a,* 78*b,* 78*c* and 80*a,* 80*b,* 80*c* have first ends 82 secured to the mattress body 12 and free second ends 84. A releasable fastener 86 is fixed to the second ends 84 of at least one of each first and second strap 78*a,* 78*b,* 78*c* and 80*a,* 80*b,* 80*c*. The second ends 84 of the first and second straps 78*a,* 78*b,* 78*c* and 80*a,* 80*b,* 80*c* cooperate such that the releasable fastener 86 secures the straps around the body of the individual supported on the mattress 10.

The releasable fastener 86 may comprise any conventional securing mechanism, such as snaps, buckles and hooks. However, in the most preferred embodiment of the invention, the releasable fastener 86 comprises a hook and loop fastener including a hook portion 86*a* attached to the second end 84 of each first strap 78*a,* 78*b,* 78*c* and a loop portion 86*b* attached to the second end 84 of each second strap 80*a,* 80*b,* 80*c*.

The securing device 76 also preferably comprises a flexible sheet 88 extending outwardly from the first or second side edges 22 and 24 of the mattress body 12. The flexible sheet 88 includes opposing first and second longitudinally extending sides 90 and 92. The first side 90 is secured to the mattress body 12 by releasable fasteners 94. Each releasable fastener 94 may comprise any conventional securing device, such as snaps, hooks and buckles, but most preferably comprises a hook and loop fastener, with a hook portion 94*a* secured to the first side 90 of the sheet 88 and a loop portion 94*b* secured to one of the sides 22 and 24 of the mattress body 12. The first side 90 of the flexible sheet 88 is positioned intermediate the securing straps 78*a,* 78*b,* 78*c* and 80*a,* 80*b,* 80*c* of the respective first and second side edges 22 and 24 and the upper surface 14 of the mattress body 12. As such, the first and second straps 78*a,* 78*b,* 78*c* and 80*a,* 80*b,* 80*c* serve to secure the sheet 88 about the body of the individual supported on the mattress 10.

It should be appreciated that in an alternative embodiment of the present invention, the securing straps 78*a,* 78*b,* 78*c* and 80*a,* 80*b,* 80*c* may be directly fastened to the sheet 88 as opposed to the mattress body 12. Similarly, first and second flexible sheets 88 and 88' may be similarly secured to both the first and second side edges 22 and 24 of the mattress body 12 through the use of releasable fasteners 94.

In operation, when it is desired to turn an individual from a supine to a prone position, the mattress 10 is positioned with the upper surface 14 facing the front of the individual. The top edge 18 of the mattress body 12 is positioned proximate the head of the individual, while the bottom edge 20 of the mattress 12 is positioned near the feet of the individual. As appropriate, the abdominal receiving chamber 34 is positioned to receive the abdomen of the individual. If the abdominal receiving chamber 34 is not required, then the plug 46 and cover 47 may be positioned on the mattress body 12 as detailed above.

The head of the individual is positioned for support by the adjustable pillow 60, while the shoulders of the individual are positioned for support by the shoulder support 48. The first securing sheet 88, and alternatively second securing sheet 88', are wrapped around the body of the individual and then secured in place by the securing straps 78*a,* 78*b,* 78*c* and 80*a,* 80*b,* 80*c*. The caregivers then rotate the mattress 10 about the longitudinal axis 26 with the individual secured thereto. The lower surface 16 of the mattress 10 is then placed on a support, such as a bed or table wherein the individual is now in a prone position. The straps 78*a,* 78*b,* 78*c* and 80*a,* 80*b,* 80*c* are then released along with the sheets 88 and 96.

In order to replace a individual in the supine position, the above process is merely reversed.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A mattress for supporting an individual in a prone position, said mattress comprising:

a resilient mattress body, said mattress body including opposing upper and lower surfaces, opposing top and bottom edges, and opposing first and second side edges connecting said top and bottom edges;

an inner abdominal support wall defining an abdominal receiving chamber positioned intermediate said top and bottom edges and extending downwardly from said upper surface of said mattress body, said abdominal receiving chamber adapted for receiving the abdomen of an individual;

an adjustable shoulder support positioned intermediate said top edge and said abdominal receiving chamber, said adjustable shoulder support including a shoulder support surface adapted for contacting the shoulders of an individual and an adjustment device for moving said shoulder support surface relative to said upper surface of said mattress body, wherein said adjustable shoulder support includes a chamber positioned intermediate said top edge and said abdominal receiving chamber, said chamber being defined intermediate said upper surface of said mattress and said shoulder support surface, and an open end in communication with said chamber, and said adjustment device includes an insert slidably receivable within said chamber of said shoulder support through said open end; and an inflatable pillow positioned above said upper surface of said mattress body intermediate said shoulder support and said top edge.

2. The mattress as recited in claim 1 wherein:

said adjustable shoulder support includes a chamber positioned intermediate said top edge and said abdominal receiving chamber, said chamber being defined intermediate said upper surface of said mattress and said shoulder support surface, and an open end in communication with said chamber; and said adjustment device includes an insert slidably receivable within said chamber of said shoulder support through said open end.

3. The mattress as recited in claim 1 wherein said pillow including a head support surface and a plurality of recesses extending downwardly from said head support surface.

4. The mattress as recited in claim 1 further comprising a securing device extending above said upper surface of said mattress body from proximate said first side edge to proximate said second side edge, said securing device adapted for securing said mattress body to an individual.

5. The mattress as recited in claim 1 further comprising a securing device extending above said upper surface of said mattress body from proximate said first side edge to proximate said second side, wherein:

said securing device includes at least one securing strap having first and second ends, said first end secured to said mattress body proximate at least one of said opposing side edges of said mattress body; and said securing device further includes a releasable fastener for securing said second end of said at least one securing strap relative to said mattress body edge.

6. The mattress as recited in claim 1 further comprising a securing device extending above said upper surface of said mattress body from proximate said first side edge to proximate said second side edge;

said securing device including a flexible sheet having opposing first and second longitudinally extending sides, said first longitudinally extending side being secured proximate said first side edge of said mattress body and said second longitudinally extending side being free; and said securing device further including at least one securing strap having a first end, a second end, and a releasable fastener for securing said second end of said at least one securing strap relative to said mattress body.

7. A mattress for supporting an individual in a prone position, said mattress comprising:

a resilient mattress body, said mattress body including opposing upper and lower surfaces, opposing top and bottom edges, and opposing first and second side edges connecting said top and bottom edges;

an inner abdominal support wall defining an abdominal receiving chamber positioned intermediate said top and bottom edges and extending downwardly from said upper surface of said mattress body, said abdominal receiving chamber adapted for receiving the abdomen of an individual;

an outer abdominal support wall positioned outside said inner abdominal support wall;

upper and lower walls extending between said inner and outer abdominal support walls to define an inflatable chamber intermediate said inner abdominal support wall and said outer abdominal support wall;

an adjustable shoulder support including a shoulder support surface adapted for contacting the shoulders of an individual, a chamber positioned intermediate said top edge and said abdominal receiving chamber, said chamber being defined intermediate said upper surface of said mattress and said shoulder support surface, and an open end in communication with said chamber; and an insert slidably receivable within said chamber of said shoulder support through said open end.

8. The mattress as recited in claim 7 further comprising:

an adjustable shoulder support including a shoulder support surface adapted for contacting the shoulders of an individual, a chamber positioned intermediate said top edge and said abdominal receiving chamber, said chamber being defined intermediate said upper surface of said mattress and said shoulder support surface, and an open end in communication with said chamber; and an insert slidably receivable within said chamber of said shoulder support through said open end.

9. The mattress as recited in claim 7 wherein said inner and outer abdominal support walls have generally cylindrical configurations and are substantially concentrically disposed relative to each other thereby defining a substantially toroidal inflatable chamber.

10. The mattress as recited in claim 7 further comprising an inflatable pillow positioned above said upper surface of said mattress body intermediate said abdominal receiving chamber and said top edge.

11. The mattress as recited in claim 7 further comprising an inflatable pillow positioned above said upper surface of said mattress body intermediate said abdominal receiving chamber and said top edge, said pillow including a head support surface and a plurality of recesses extending downwardly from said head support surface.

12. The mattress as recited in claim 7 further comprising a securing device extending above said upper surface of said mattress body from proximate said first side edge to proximate said second side edge, said securing device adapted for securing said mattress body to an individual.

13. The mattress as recited in claim 7 further comprising a securing device extending above said upper surface of said mattress body from proximate said first side edge to proximate said second side, wherein:

said securing device includes at least one securing strap having first and second ends, said first end secured to said mattress body proximate at least one of said opposing side edges of said mattress body; and said securing device further includes a releasable fastener for securing said second end of said at least one securing strap relative to said mattress body edge.

14. The mattress as recited in claim 7 further comprising a securing device extending above said upper surface of said mattress body from proximate said first side edge to proximate said second side edge;

said securing device including a flexible sheet having opposing first and second longitudinally extending sides, said first longitudinally extending side being secured proximate said first side edge of said mattress body and said second longitudinally extending side being free; and said securing device further including at least one securing strap having a first end, a second end, and a releasable fastener for securing said second end of said at least one securing strap relative to said mattress body.

* * * * *